United States Patent [19]

Bressler

[11] 4,207,630

[45] Jun. 17, 1980

[54] METHOD OF REPAIRING WATER CLOSET ANCHORING TO FRACTURED CLOSET FLANGE AND SPANNER CLAMP THEREFOR

[76] Inventor: Mark Bressler, 1081 Hartwig, Troy, Mich. 48098

[21] Appl. No.: 36,785

[22] Filed: May 7, 1979

[51] Int. Cl.[2] ..... E03D 11/00

[52] U.S. Cl. ..... 4/252 R; 4/661; 29/402.11; 29/402.09; 138/97; 138/98

[58] Field of Search ..... 4/420, 252 R; 29/401.1, 29/402.08, 402.11, 402.09; 138/97, 98, 99

[56] References Cited

U.S. PATENT DOCUMENTS

| | | | |
|---|---|---|---|
| 1,322,245 | 11/1919 | Klassen | 29/402.11 X |
| 2,998,645 | 9/1961 | Diperstein | 29/402.11 |
| 3,321,924 | 5/1967 | Liddell | 138/97 X |
| 3,775,780 | 12/1973 | McEwen | 4/420 X |
| 3,846,851 | 11/1974 | Pepper | 4/252 R |
| 4,038,737 | 8/1977 | Bretone, Jr. | 29/402.08 |
| 4,147,576 | 4/1979 | Beem et al. | 29/402.09 |

*Primary Examiner*—Henry K. Artis

*Attorney, Agent, or Firm*—Cullen, Sloman, Cantor, Grauer, Scott & Rutherford

[57] ABSTRACT

The method of repairing a water closet anchoring to a fractured broken away closet flange which comprises the steps of disconnecting and disassembling the water closet from the closet flange, and assembling an arcuate slotted repair spanner clamp upon the undersurface of the closet flange spanning the fracture therein. A further step includes projecting a headed fastener up through the anchor clamp and finally reassembling the water closet over said anchor clamp and securing the same thereto. The invention further includes an improved repair spanner clamp of arcuate form adapted to underlie and span the fractured portion of a closet flange to facilitate reanchoring the water closet thereto.

10 Claims, 4 Drawing Figures

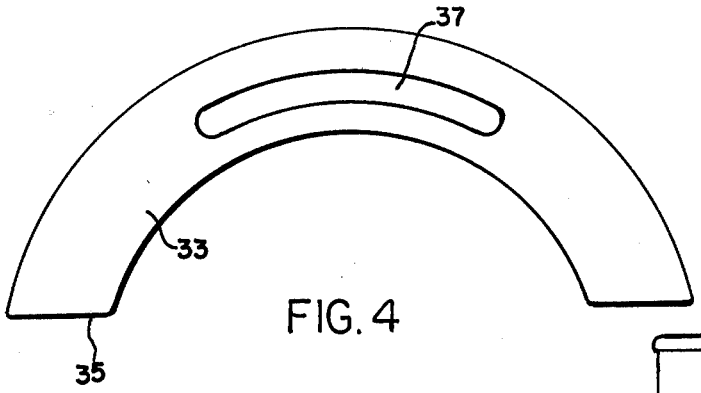
FIG. 4
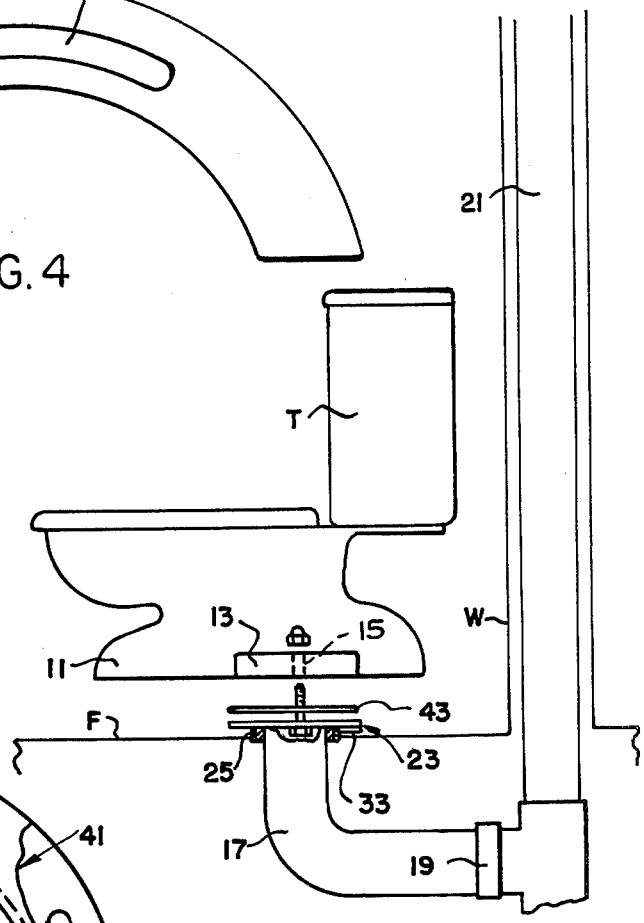
FIG. 1
FIG. 2
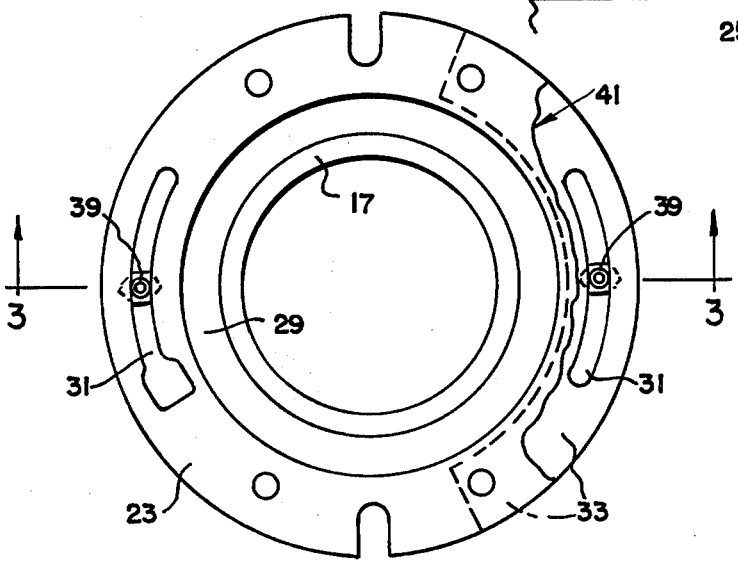
FIG. 3
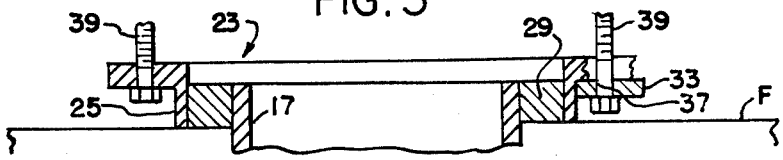

METHOD OF REPAIRING WATER CLOSET ANCHORING TO FRACTURED CLOSET FLANGE AND SPANNER CLAMP THEREFOR

BACKGROUND OF THE INVENTION

As is known in the art, closet flanges are conventionally used for receiving the anchor flanges of a water closet for securing the same to an adjacent floor surface. The closet flange conventionally is fixedly secured to the upper open end of a drain pipe which normally projects up to or partly through the floor surface. Such connection is usually be lead or other pipe fastening. Heretofore due to transverse stresses upon the water closet when the closet flange has become fractured or broken, the water closet can tip and has lost its seal and snug tight connection with the floor surface.

A conventional practice is to disconnect the water closet and thereafter with a very arduous effort remove and replace the existing closet flange and assemble a replacement closet flange. This normally takes the average worker approximately two to three hours due to the difficulty of removing the existing closet flange and replacing it.

An investigation into prior earlier patents was conducted in the Patent Office Records under Class 4, Sub-Classes 252, Class 137, Sub-Class 315. Prior art attachments of part of a water closet to other part of a water closet and means for anchoring water closets to floors and drain pipes are illustrated in the following U.S. Pat. Nos.: 572,575; 1,041,905; 946,861; 605,780; 2,017,600.

SUMMARY OF THE INVENTION

It is an object of the present invention to provide a method of repairing the water closet anchoring to a fractured and broken away closet flange which comprises disassembly of the water closet from the broken flange and thereafter the assembling of an arcuate slotted repair spanner clamp upon the undersurface of the closet flange so as to span the fractured portion thereof. A further step includes projecting a headed fastener up through the spanner clamp for anchoring the same, and thereafter reassembling the water closet with respect to the closet flange and anchor clamp and securing the same thereto.

It is another object to provide an improved unit metalic arcuate spanner clamp which is substantially flat, and transversely apertured to be used in conjunction with the reanchoring of a water closet to a fractured closet flange and wherein the spanner clamp is positioned on the undersurface of the fractured closet flange and the water closet reassembled thereover to thereby provide a new anchoring for the fastener which secures the water closet to the closet flange.

The present method of repairing the water closet anchoring to a fractured broken away closet flange comprises the steps of disconnecting the water closet from the fractured closet anchor flange and thereafter assembling an arcuate slotted repair spanner clamp upon the underside of said fractured closet flange so as to span the fractured portion thereof. Further steps include the projecting of a headed fastener up through the spanner clamp for anchoring said fastener and thereafter reassembling the water closet over said closet flange so that its apertured mount flange is in registry with said spanner clamp, closet flange and fastener and thereafter resecuring the water closet upon the repaired closet flange.

The closet flange is usually arcuate with conventional T-slots therein, and is of a predetermined width. The repair spanner flange is of substantially the same width as the closet flange and of the same curvature so as to cooperatively engage contiguous undersurface portions of said closet flange at opposite ends of the fracture therein to provide new anchoring base for the water closet to facilitate repair of the fractured closet flange and the reassembly of the water closet thereover.

The spanner clamp extends through an arc between 90 and 180 degrees approximately. The assembly is such that the arcuate outer surface of the spanner clamp is in registry with and generally coincides with the outer curvature of the closet flange.

These and other objects will be seen from the following specification and claims in conjunction with the appended drawing.

THE DRAWING

FIG. 1, is an exploded schematic side view illustrating the positioning of the replacement repair spanner flange to underlie a fractured portion of a closet flange.

FIG. 2, is a plan view of the closet flange partly broken away and sectioned, on an increased scale, and illustrating the application of the spanner clamp upon the undersurface thereof.

FIG. 3, is a fragmentary section taken in the direction of arrows 3—3 of FIG. 2.

FIG. 4, is a plan view fo the present repair spanner clamp corresponding to FIG. 2.

It will be understood that the above drawing illustrates merely an illustrative and preferred embodiment of the invention, and that other embodiments are contemplated within the scope of the claims hereafter set forth.

DETAILED DESCRIPTION OF ONE EMBODIMENT OF THE INVENTION

Referring to the drawing, the environment for the present invention includes the conventional floor F, wall W, water closet W. C., and tank T.

The conventional water closet normally has a pair of spaced mount flanges 13 having one or more upright apertures 15 designed for anchoring the water closet upon the floor. A conventional closet drain pipe is schematically shown at 17 extending from below the floor up to and possibly partly above the floor a short distance. Drain pipe 17 joins a suitable T-fitting 19 which connects a conventional sewer drain and normally has thereabove extending to the building roof a stack vent 21. This is conventional construction.

The conventional closet flange 23 is usually circular, normally has a pair of oppositely arranged arcuate T-slots 31 adapted to receive the conventional headed anchoring fastener 39 and normally has additional conventional apertures therethrough such as shown in FIG. 2 affording various means by which the closet flange may be secured to a floor surface.

The present and conventional closet flange includes annular ring 25 of less diameter with respect to the outer diameter of the closet flange and which depends therefrom as shown in FIG. 3. Said ring is concentrically arranged with respect to the open end of the drain pipe 17 and is suitably secured thereto such as by the annular lead connector 29 which is usually applied in molten form or other compositions or glue or adhesives.

These are conventional in nature to provide a rigid securing of the closet flange 33 to the drain pipe. In normal assemblies the closet flange is spaced above the floor F, such as shown in FIG. 3 so as to at least receive the head of the closet bolt or fastener 39, FIGS. 1 and 3.

Suffice it to say that since it is required that the water closet be firmly anchored to the floor to avoid tipping thereof or transverse movement, there is a very tight securing of the closet flange with respect to the drain pipe 17 and the adjacent floor. As is known in the past should the closet flange or a part thereof fracture as shown at 41 and break away, the anchoring of the adjacent fastener 39 is lost with the result that the water closet is no longer firmly anchored but is capable of some tipping movement.

Normally as in the prior art a plumber or other person disconnects the fasteners 39 so that the water closet as a unit including its mount flanges 13 is disassembled from its conventional location. There then follows the very difficult task of removing the conventional closet flange 23 from its very tight connection with the drain pipe 17. This is an arduous job that usually takes two to three hours since normally there is a lead annular ring 29 which has been poured into place to provide the initial anchoring shown in FIG. 3. Other annular connections are known which are very tight and difficult to disconnect.

The present invention contemplates elimination of the removal of the fractured and broken closet flange and instead merely provide a repair therefor which can be done in a fraction of the time namely, a few minutes and by which the water closet can be reassembled and resecured in place.

In the present invention there is provided a closet flange repair spanner clamp generally indicated at 33, FIG. 4, which is preferably metalic such as steel, although it could be constructed of a stiff plastic material such as polystyrene.

The spanner clamp has radial end portions 35 and an elongated arcuate slot 37 intermediate its ends which could be a T-slot if desired such as shown at 31, FIG. 2.

The present spanner clamp is normally less than 180° in extent, and may range in peripheral length between 90 and 180 degrees, approximately for illustration. Said clamp is flat and rectangular in cross section.

The primary objective is to make a repair for the existing closet flange by the present method of repairing the water closet anchoring to such fractured closet flange. This includes the steps as follows:

disconnecting and disassembling the water closet from the fractured closet flange;

assembling an arcuate slotted repair spanner clamp upon the undersurface of the closet flange spanning the fractured portion thereof;

projecting a headed fastener up through said spanner clamp for anchoring the fastener to the closet flange.

a further step includes reassembling the water closet over the repaired closet flange with its mount flange in registry with the spanner clamp and thereafter resecuring the water closet to said closet flange by said fasteners.

Normally the closet flange is irregular in shape, such as arcuate, but not excluding other shapes, and that the repair spanner clamp employed which underlies the surface of the closet flange primarily is adapted to span the fractured portion thereof and to register with the undersurface portions of the closet flange for cooperative contiguous surface engagement therewith to provide an easily accessible repair for the fractured closet flange.

Accordingly utilizing the present method, the repair spanner clamp is generally arcuate in form corresponding generally to the shape of the closet flange conventionally employed. Thus it substantially registers with the arcuate undersurface thereof at the fractured area. The outer arcuate surface of the spanner clamp corresponds generally and substantially to the arcuate edge of the closet flange.

In the reassembly of the water closet over the repaired closet flange there is normally employed a conventional wax or other resilient sealing gasket 43 such as shown in the exploded view in FIG. 1.

While the present invention is primarily directed to the method of repairing the water closet anchoring to a fractured and broken away closet flange, the present invention is furthermore directed to an article of manufacture namely, the arcuate spanner clamp which is utilized in the environment above described. The spanner clamp underlies and is coextensive with the fractured portion of the closet flange so as to span the same, and is apertured to receive a headed fastener. The spanner clamp and fastener are reassembled with respect to the fractured closet flange, with the fastener upon the opposite side of the closet flange arranged in place as is conventional. The water closet flange 13 is then reassembled with respect to the fasteners to engage the floor surface such as shown in FIG. 1, and the fasteners such as nuts are applied to the upper ends of the upright closet bolts 39 thereby resecuring and reanchoring the water closet to the repaired closet flange.

Though it is unlikely that both sides of the closet flange would be fractured, it is possible. Accordingly, in such case a pair of the present repair spanner clamps could be employed to accomplish the same result namely, to provide a repairing of the water closet anchoring to such fractured broken away closet flange.

Use of the present closet flange repair spanner clamp eliminates most of the very high labor costs involved in the conventional old procedure of replacing the closet flange and at the same time provides an inexpensive means for repair such fractured flange normally accomplished within a few minutes not to exceed fifteen to thirty minutes approximately.

The spanner clamp or flange can also be used under a plastic closet flange which is commonly used in new construction. The present flange would eliminate cutting off an existing plastic closet flange and coupling on a new flange. In a typical first floor instalation a plumber could cut off and replace a broken close flange (plastic) in approximately two hours time; but on the second floor the job would become a four to six hour job and possibly hundreds of dollars in damage. The present spanner flange would simply span the cracked or broken section of a plastic flange the same as on a cast iron flange.

Having described my invention reference should now be had to the following claims.

I claim:

1. The method of repairing the water closet anchoring to a fractured broken away closet flange which comprises:

disconecting and disassembling the water closet from said fractured closet flange;

assembling a slotted repair spanner clamp upon the undersurface of said closet flange spanning the fractured portion thereof;

projecting a headed fastener up through said spanner clamp for anchoring said fastener to said closet flange;

and reassembling the water closet over said closet flange with its mount flange in registry with said spanner clamp and resecuring said water closet mount flange to said fastener.

2. In the method of claim 1, said closet flange being arcuate and of a predetermined width, said spanner clamp being substantially the width of said closet flange to cooperatively engage contiguous portions of said closet flange at opposite ends of the fracture therein, providing an easily accessible repair therefor.

3. In the method of claim 1, said spanner clamp extending through an arc greater than 90° and less than 180°.

4. In the method of claim 1, the outer arcuate edge of said spanner clamp lying within the outer periphery of said closet flange.

5. In combination with a closet drain pipe extending to a floor and a circular closet flange having an annular apertured depending ring mounted upon and secured to said drain pipe above said floor;

a water closet having an apertured mount flange in registry with said closet flange and bearing upon said floor;

and fasteners connecting and securing said water closet mount flange to said closet flange;

a portion of said closet flange being fractured and broken away;

the improvement comprising an apertured repair spanner clamp underlying said closet flange and spanning its fractured portion, one of said fasteners being anchored to and extending up through said spanner clamp and through said water closet mount flange and secured thereto.

6. In the combination of claim 5, said closet flange being arcuate and of a predetermined width, said spanner clamp being substantially the width of said closet flange to cooperatively engage contiguous portions of said closet flange at and beyond opposite ends of the fracture therein, providing an easily accessible repair therefor.

7. In the combination of claim 5, said spanner clamp extending through an arc greater than 90° and less than 180°.

8. In the combination of claim 5, the outer arcuate edge of said spanner clamp lying within the outer periphery of said closet flange.

9. In connection with the anchoring of the mount flange of a water closet to a closet flange adjacent a floor including fasteners extending up through said closet flange and through said mount flange and secured thereto;

the method of repairing said anchoring when the closet flange is fractured which includes:

disconnecting the water closet mount flange from said closet flange;

and introducing a spanner clamp to underlie the closet flange spanning its fracture, and reassembling and securing the water closet to said spanner clamp.

10. In the combination of claim 5, said spanner clamp being flat and rectangulr in cross section.

* * * * *

US004207630B1

REEXAMINATION CERTIFICATE (3807th)

United States Patent [19]

Bressler

[11] B1 4,207,630

[45] Certificate Issued Jul. 13, 1999

[54] METHOD OF REPAIRING WATER CLOSET ANCHORING TO FRACTURED CLOSET FLANGE AND SPANNER CLAMP THEREFOR

[76] Inventor: Mark Bressler, 1081 Hartwig, Troy, Mich. 48098

Reexamination Request:
No. 90/004,829, Nov. 7, 1997

Reexamination Certificate for:

| | |
|---|---|
| Patent No.: | **4,207,630** |
| Issued: | **Jun. 17, 1980** |
| Appl. No.: | **06/036,785** |
| Filed: | **May 7, 1979** |

[51] Int. Cl.[6] ..... E03D 11/17

[52] U.S. Cl. ..... 4/252.4; 4/661; 29/402.09; 29/402.11; 138/97; 138/98

[58] Field of Search ..... 4/252.1–252.6; 285/15, 16, 56–60; 29/402.09, 402.11; 138/97, 98

[56] References Cited

U.S. PATENT DOCUMENTS

| | | | |
|---|---|---|---|
| 572,575 | 12/1896 | Scott . | |
| 605,780 | 6/1898 | Cram . | |
| 626,223 | 6/1899 | Cramp . | |
| 630,641 | 8/1899 | Albree . | |
| 696,603 | 4/1902 | Smith . | |
| 712,022 | 10/1902 | Underhill . | |
| 750,428 | 1/1904 | Boyce . | |
| 879,176 | 2/1908 | Jackson . | |
| 938,533 | 11/1909 | Wheeler . | |
| 946,861 | 1/1910 | O'Brian . | |
| 990,646 | 4/1911 | Fisher . | |
| 1,020,929 | 3/1912 | Row . | |
| 1,041,905 | 10/1912 | Tong . | |
| 1,179,091 | 4/1916 | Ray et al. . | |
| 1,322,245 | 11/1919 | Klassen . | |
| 1,389,282 | 8/1921 | Yingling . | |
| 1,456,761 | 5/1923 | Bylund . | |
| 1,525,647 | 2/1925 | Haughey . | |
| 1,533,444 | 4/1925 | Mohr . | |
| 1,784,667 | 12/1930 | Gillet . | |
| 2,017,600 | 10/1935 | Lofton . | |
| 2,362,454 | 11/1944 | Damsel . | |
| 2,412,418 | 12/1946 | Obermaier . | |
| 2,461,856 | 2/1949 | Tornberg . | |
| 2,558,695 | 6/1951 | Unger . | |
| 2,758,316 | 8/1956 | Schwarz et al. . | |
| 2,764,431 | 9/1956 | Wilde . | |
| 2,899,690 | 8/1959 | Clifford . | |
| 2,911,239 | 11/1959 | Marzolf . | |
| 2,998,645 | 9/1961 | Diperstein . | |
| 3,321,924 | 5/1967 | Liddell . | |
| 3,382,508 | 5/1968 | Kammermeyer . | |
| 3,419,298 | 12/1968 | Worley . | |
| 3,761,114 | 9/1973 | Blakeley | 285/111 |
| 3,775,780 | 12/1973 | McEwen | 4/252 |
| 3,846,851 | 11/1974 | Pepper | 4/252 |
| 4,038,737 | 8/1977 | Bretone, Jr. | 29/401 |
| 4,147,576 | 4/1979 | Beem et al. | 156/94 |

FOREIGN PATENT DOCUMENTS

| | | |
|---|---|---|
| 192388 | 8/1888 | France . |
| 1682 | of 1870 | United Kingdom . |
| 6709 | of 1886 | United Kingdom . |
| 14892 | of 1894 | United Kingdom . |

OTHER PUBLICATIONS

The Thomas Register, p. 9060/FLA, 1989.

The Thomas Register, p. 14245/FLA,1996.

*Primary Examiner*—Charles R. Eloshway

[57] ABSTRACT

The method of repairing a water closet anchoring to a fractured broken away closet flange which comprises the steps of disconnecting and disassembling the water closet from the closet flange, and assembling an arcuate slotted repair spanner clamp upon the undersurface of the closet flange spanning the fracture therein. A further step includes projecting a headed fastener up through the anchor clamp and finally reassembling the water closet over said anchor clamp and securing the same thereto. The invention further includes an improved repair spanner clamp of arcuate form adapted to underlie and span the fractured portion of a closet flange to facilitate reanchoring the water closet thereto.

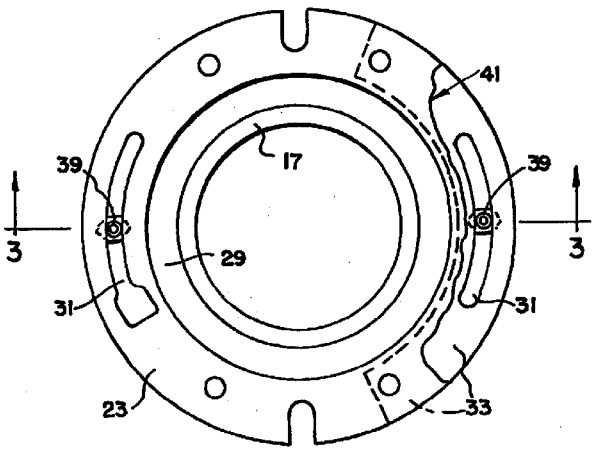

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–10 is confirmed.

* * * * *